United States Patent [19]

Helmes

[11] 4,184,525

[45] Jan. 22, 1980

[54] MILLING MACHINE

[75] Inventor: Franciscus J. Helmes, Tegelen, Netherlands

[73] Assignee: Helmes Machinefabriek B.V., Tegelen, Netherlands

[21] Appl. No.: 863,229

[22] Filed: Dec. 22, 1977

[30] Foreign Application Priority Data

Jan. 6, 1977 [NL] Netherlands ..... 7700096

[51] Int. Cl.[2] ..... B27F 1/10

[52] U.S. Cl. ..... 144/201; 144/2 R; 144/134 R; 144/323; 409/170

[58] Field of Search ..... 144/2 R, 134 R, 323, 144/200, 201, 203, 198, 309 L; 90/15 A, 18, 21.5

[56] References Cited

U.S. PATENT DOCUMENTS

| | | | |
|---|---|---|---|
| 1,956,748 | 5/1934 | Schroff | 144/203 |
| 2,586,798 | 2/1952 | Eck | 144/134 R X |
| 3,837,384 | 9/1974 | Sybertz | 144/323 X |
| 4,056,137 | 11/1977 | Morasch et al. | 144/134 R X |

FOREIGN PATENT DOCUMENTS 104722 4/1963 Netherlands .

*Primary Examiner*—Horace M. Culver

*Attorney, Agent, or Firm*—Irving M. Weiner; Pamela S. Burt; Melvin Yedlin

[57] ABSTRACT

A machine for milling a tenon to the straight end of wooden workpieces, like a strip or a beam, wherein two wooden workpieces disposed upon two sledges or tables moving in transverse position to and fro in between abutments, are milled one after another in one single pass through the machine by means of a driven cutter carried upon a support structure which periodically performs a revolving movement over 180°, each time said cutter reaches a side face of the tenon to be produced, said pivotal movement being initiated by a signal from a pulse transmitter cooperating with the sledge or table such that said signal is dependent upon the position of the relative sledge, and so that said cutter always cuts toward the tenon being cut.

4 Claims, 11 Drawing Figures

MILLING MACHINE

DISCUSSION OF THE PRIOR ART

The present invention relates to an improved machine for milling a tenon to the straight end of a wooden workpiece, such as a strip or beam, whereby two interspaced wooden workpieces are milled one after another by means of a single cutter, in one pass through the machine. The prior art machine comprises a sledge or table for the workpieces, which moves to and fro in between abutments, and a driven cutter with a support structure which enables a stepwise pivotal movement of the cutter support structure over 180° each time the cutter reaches the side face of the tenon of either of the two workpieces. This pivotal movement is initiated by a signal depending on the position of the sledge, which signal originates from a pulse transmitter cooperating with said sledge. A machine of this type is disclosed in Netherlands Patent Specification 104,722, and is available from N. V. Machinefabriek Helma-Hohama, Tegelen, Holland, as Model RP-100-PD Fully automatic tenoner. The problem with this type of tenon-cutting machine is that, as the second workpiece is moved into initial position against the cutter, the cutter cuts away from the center of the workpiece, causing wood to break out to varying degrees, which may ruin the workpiece.

BACKGROUND OF THE INVENTION

Each workpiece is so milled in one single cycle, that a tenon is produced. This cycle comprises four movements, that is to say a to and fro movement of the sledge and two pivotal movements of the cutter support. The direction of rotation of the cutter is thus that the wood is always attacked toward the center of the workpiece, so as to encounter no difficulties inherent to cutting the end of a piece of wood.

In practice, there are sometimes difficulties owing to the circumstance that both workpieces are always acted upon in one and the same cycle of sequential operations. This means that with one of the workpieces a first contact or approach of the cutter will cause the wood to break out, owing to an incorrect direction of rotation of the cutter at that location. Since such known milling machines offered many advantages, this problem has been accepted so far.

The aim of the invention is to provide a solution to the above problem without any basic change in the operation of the machine, while maintaining the constant cycle of a sequence of said operations on the workpieces, and the same direction for the translatory movements of the sledge and the two pivotal movements of the support structure of the cutter.

SUMMARY OF THE INVENTION

This aim is accomplished in accordance with the invention in that there is an additional pulse transmitter in the circuit for the pivotal movement of the support structure of the cutter, in combination with the pulse transmitters for its stepwise pivotal movement, so that this additional pulse transmitter initiates an additional backward pivotal movement of 180° of the cutter support, after every second pivotal movement of the support structure.

In consequence of this pivotal or swinging movement of the cutter support in an opposite direction, immediately after completion of one workpiece, not only will the direction of rotation of the cutter always be toward the center of the workpiece during the milling operation, but a period of standstill of the cutter occuring twice at the same position of the workpiece is also prevented. This phenomenon often caused a farther cutting of the "breast" of the tenon at the location of standstill.

The improvement of the existing machine can be applied in a milling machine which operates with a single sledge or table for two workpieces, as is the case in the prior art milling machine.

According to the invention further improvement is obtained when there is a separate sledge or table for each of the two workpieces, these sledges being provided with a movable abutment cam, and a third auxiliary sledge with two adjustable abutments for cooperation with the abutment cams mentioned above.

Owing to these features, adjustment of the width of the tenon will no longer be dependent upon the location of said workpiece so that shorter and simpler times of adjustment are obtained. Furthermore there may be greater intervals for the supply and discharge of the workpieces from and to the stores.

Each sledge or table is provided with a pneumatic drive by means of a plunger or piston, where the surface area of the piston belonging to the auxiliary sledge exceeds the surface area of the pistons of the sledges for the work pieces. Owing thereto an exact location and controlled movement of the sledge can be ensured during milling the tenon.

The invention also relates to a method of operating the machine as described hereinbefore, whereby each workpiece sledge performs a forward stroke toward the cutter and a backward stroke away from the cutter, wherein a pulse for pivoting the support structure of the cutter is given at the end of the forward stroke of each workpiece sledge, a further a pulse is given at the end of the stroke of the auxiliary sledge, and an extra pulse for a backward pivotal movement over 180° is given after each second pivotal movement of the support structure.

BRIEF DESCRIPTION OF THE DRAWING

FIG. 1 to 11 show the eleven sequential phases of the entire operational cycle of the machine.

DESCRIPTION OF A PREFERRED EMBODIMENT

Figure 2:
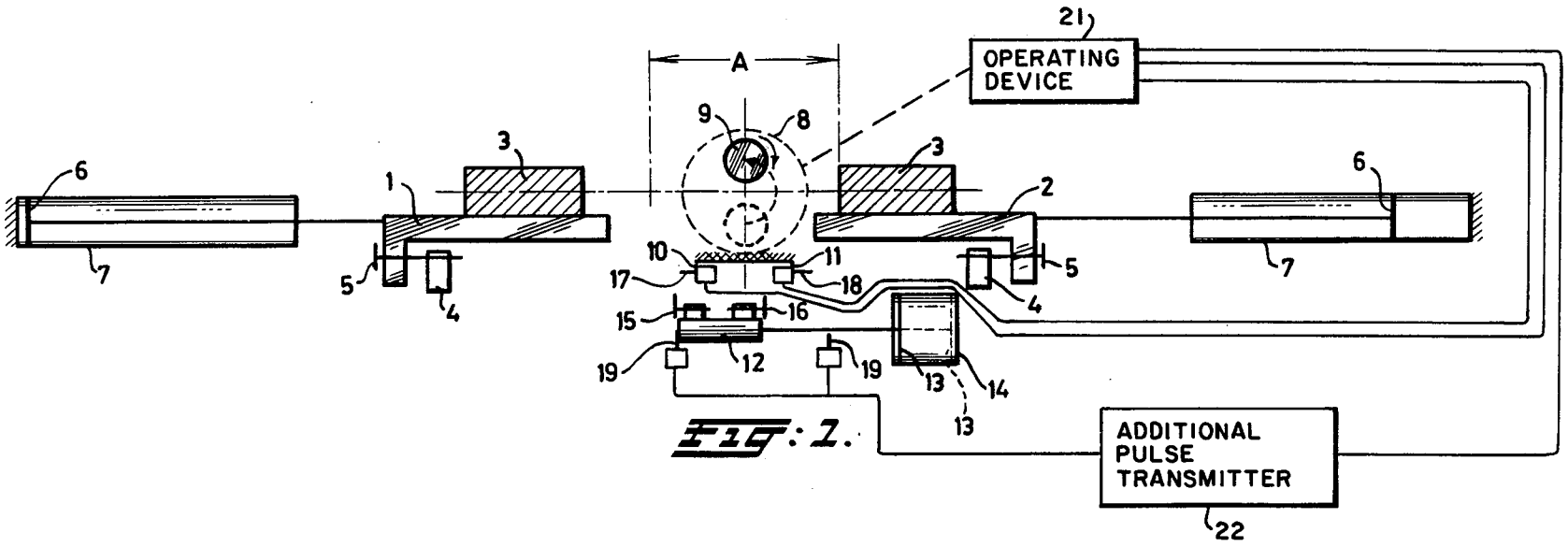
Figure 2:
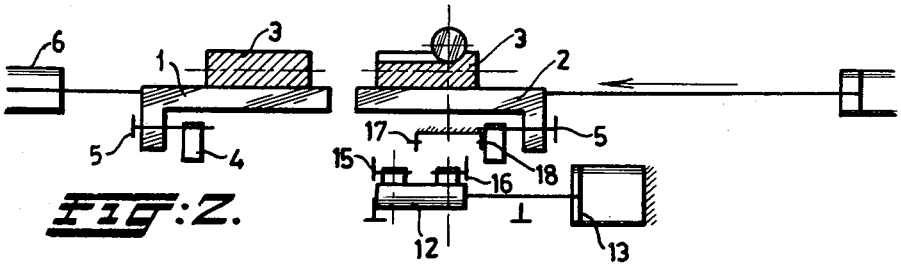

The machine in accordance with the invention is derived from and is an improvement of the older machine as described above.

The machine includes two sledges 1 and 2 on each of which a workpiece i.e. a wooden strip or a beam 3 is fixed. Each sledge 1, 2 has a displaceable abutment cam 4, the position of which can be adjusted by means of an adjusting element 5. Each sledge 1,2 has a pneumatic drive by means of a plunger or piston 6 which can move to and fro within a cylinder 7. The sledges 1, 2 are on either side of a central support 8 for a driven cutter 9. By means of said structure 8, the cutter 9 can be pivoted or swung stepwisely over 180° . In the central area A between the sledges 1,2 there are two abutments 10 and 11 for cooperation with the abutment cams 4 of the sledges 1 and 2.

The central area A of the machine also includes a third auxiliary sledge 12 which is also moved through a pneumatic drive formed by a piston 13 which can move to and fro within a cylinder 14. The auxiliary sledge 12 is provided near its two ends with an adjustable abutment 15, 16 for cooperation with the abutment cams 4 of the sledges 1 and 2. The surface of the piston 13 exceeds the surface of the piston 6, so that the auxiliary sledge 12 can move the workpiece sledges 1 and 2 in opposition to the force of the piston 6.

There is a pulse transmitter 17 or 18 in the path of each abutment cam 4 upon the abutment 10 and 11. There is a further pulse transmitter 19 at the end of the to and fro stroke of the auxiliary sledge 12. These pulse transmitters transmit a signal to an operating device 21 of the support structure 8, whereby the structure is such that a pivotal movement over 180° is performed by the support structure 8 after receipt of each signal from one of the transmitters 17, 18 and 19, these pivotal movements being performed in a repeating sequence of two clockwise movements preceeded by a single counterclockwise movement.

Figure 3:
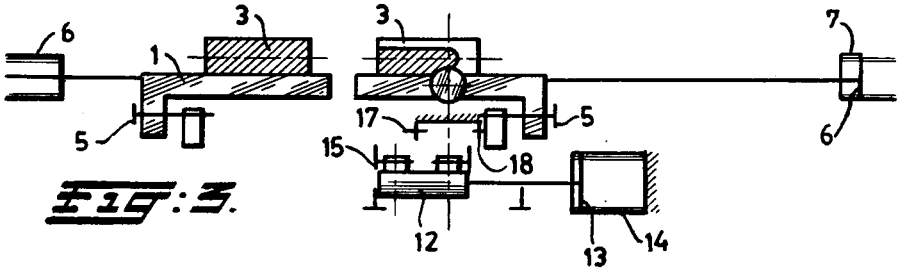

The present apparatus operates as follows;

FIG. 1 shows the situation whereby the two workpieces 3 are still uncut while the right-hand sledge 2 with the workpiece 3 fixed thereupon is performing a forward stroke toward the cutter 9. The support structure 8 has just performed a pivotal movement so that the cutter 9 is in its upper position. The pneumatic drive 6, 7 drives the sledge 2 until the abutment 4 contacts the abutment 11. This situation is shown in FIG. 2. Where the cutter 9 has cut the upper right-hand side of the tenon. When the abutment 11 is reached, the abutment cam 4 will also contact the pulse transmitter 18, so that the support structure 8 performs a first pivotal movement over 180° , which movement is shown in FIG. 3. As the cutter is continuously rotating, a round end of the tenon is cut.

Figure 4:
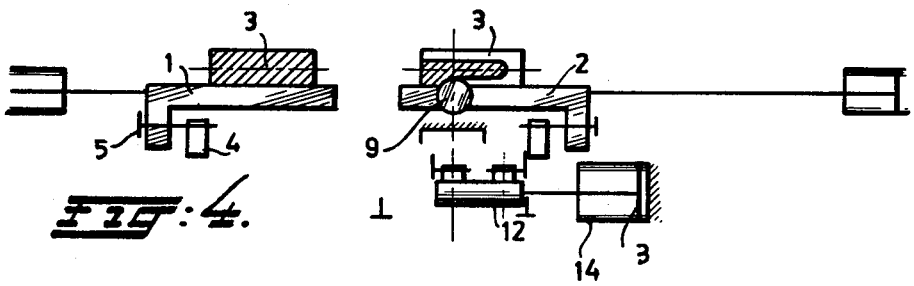
Figure 5:
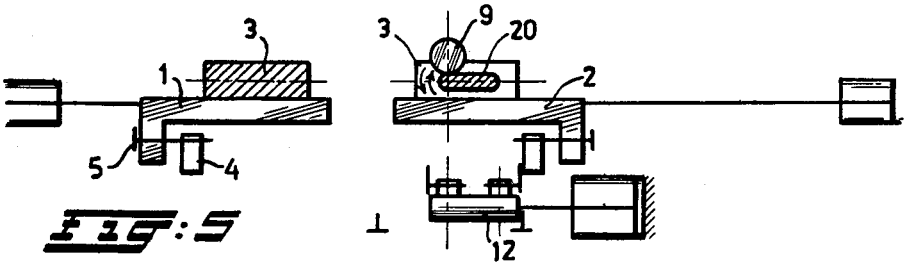

After completion of the action of FIG. 3 the pneumatic drive 13, 14 will move the auxiliary sledge 12 to the right. The abutment 16 contacts the abutment cam 4, and the sledge 2 is moved to the right hereby (see FIG. 4). This backward movement of the sledge 2 in opposition to the force of the pneumatic drive 6,7 is possible because the surface of the piston 13 exceeds that of the piston 6. During this backward movement the second straight side of the tenon is cut. At the end of the stroke of the auxiliary sledge 12 this sledge will contact the pulse transmitter 19 so that the support structure 8 will again perform a movement over 180° , whereby the second round side of the tenon is created (see FIG. 5). Immediately thereafter an extra pulse transmitter 22 in the circuit of the support structure becomes active so that a backward pivotal movement over 180° of the structure 8 is begun, to move the cutter 9 is again in its lower position. Simultaneously, the pneumatic drive 6 and 7 for performing the backward stroke of the sledge 2 is activated, while the drive 6, 7 of the sledge 1 initiates its forward stroke toward the cutter. At that moment there is a free space A in between the two workpieces 3.

Figure 6:
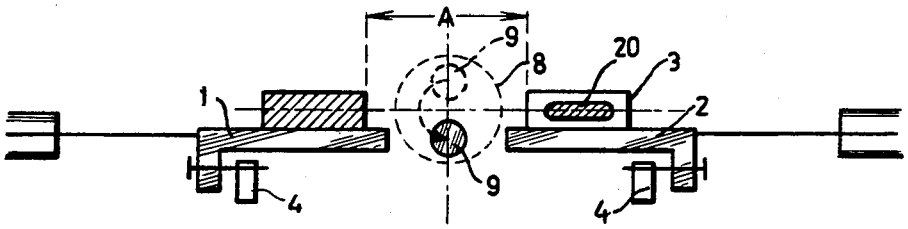
Figure 7:
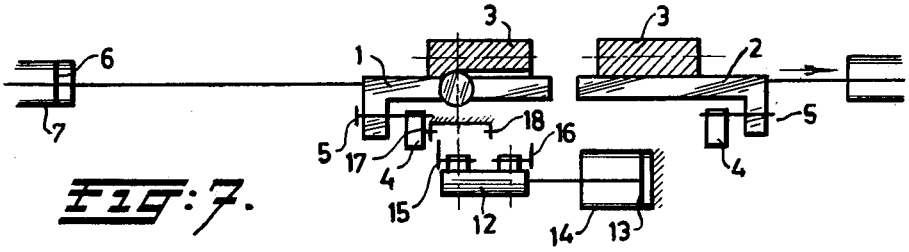
Figure 8:
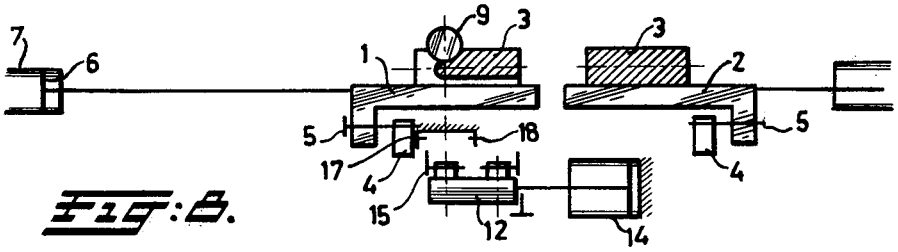
Figure 9:
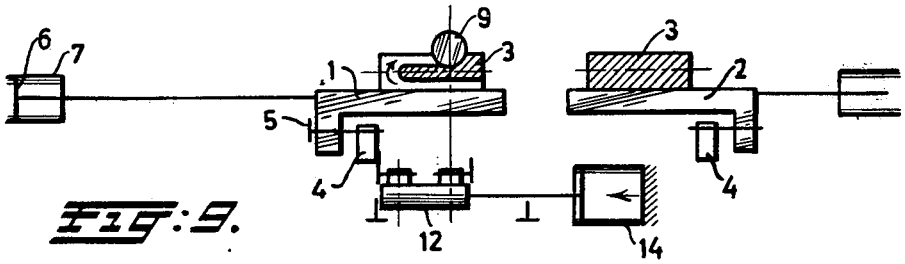

The extra movement of the cutter 9 from its upper to its lower position as described above, depends upon the direction of rotation of the cutter 9 and the first contact or attack of the cutter upon the left-hand workpiece 3. Without this intermediate pivotal movement of the support structure 8, the wood of the workpiece can break out at the location of the first contact, as the rotating cutter then cuts away from the center of the workpiece. This is not the case in the situation of FIG. 6.

When continuing this stroke of the sledge 1, the first straight side of the tenon is produced.

Figure 10:
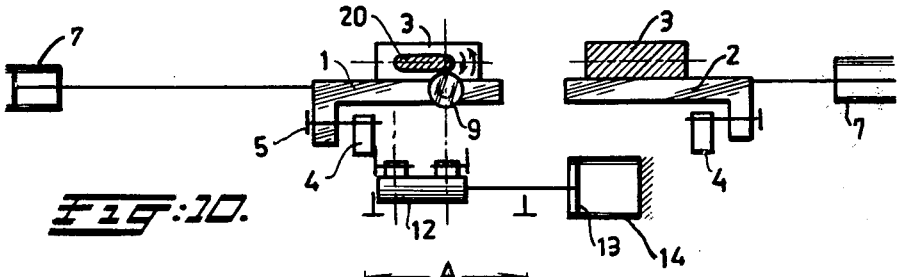
Figure 11:
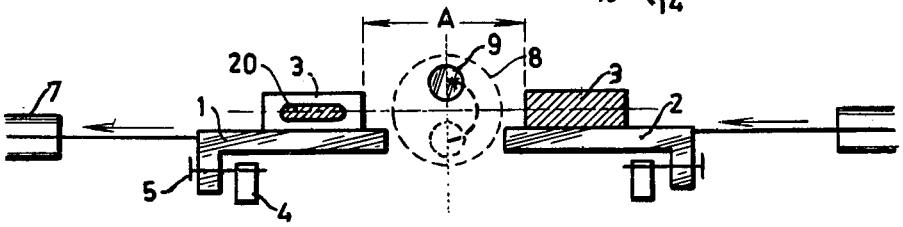

FIGS. 7 to 10 show, in relation to the sledge 1 and the workpiece 3, the same actions as FIGS. 2 to 5 show, with respect to the sledge 2 with the workpiece 3. FIG. 10 shows the ready made tenon 20 after the completed second pivotal movement of the support structure 8. The extra pulse transmitter 21 of the circuit for the pivotal movement of the structure 8 will immediately perform a backward movement over 180° , so that the cutter 9 will be in its upper position, as shown in FIG. 11. The sledge 1 in the meantime will have commenced its backward stroke, while the sledge 2 will initiate its forward stroke. There will then be a situation corresponding to FIG. 1 wherein the right-hand workpiece to be provided with a tenon, will be acted upon from its upper side so that the rotation of the cutter 9 cannot possibly cause a break out of the wood.

Owing to the presence of the aforementioned extra pulse transmitter the cutter 9 will, during its transition from one workpiece to the other, be given a position such that no danger will be involved with respect to break out of the wood at a first contact between the rotating cutter and the workpiece with a given direction of rotation of said cutter. It is a further advantage of the invention that two separate sledges 1 and 2 are applied, each having an adjustable cam 4 by means of which the position of the curved side of the tenon 20 can be determined. An auxiliary sledge 12 with its adjustable abutments 15 and 16 determines the position of the second round side of the tenon 20.

It is observed that the piston 13 of the cylinder 14 always performs a complete stroke, and that by means of the adjustment of the abutments 15 and 16, the location of one round side of the tenon 20 is defined.

The pistons 6, on the contrary, move backward to the bottom of the cylinders 7, but the length of the forward stroke is determined by adjustment of the abutment cams 4. In this manner the position of the first cut round side of the tenon 20 is determined.

What is claimed is:

1. A machine for milling a tenon at the end of a wooden beam-shaped workpiece wherein two interspaced workpieces are milled sequentially by a single cutter, comprising:

sledge means for supporting said workpiece;

first means for linearly moving said sledge means;

first and second abutment means for stopping said sledge means at a first set of predetermined positions;

pivoting support means for said cutter for pivotally moving said cutter between two predetermined positions separated by 180° ;

an operating device responsive to a pulse for causing said pivoting support means to pivot;

second means including pulse transmitters operated by said sledge means to transmit one said pulse to said operating device when said sledge means reaches a second set of predetermined positions; and third means for transmitting an additional said pulse to said operating device following each second one of said pulses from said pulse transmitters, whereby said support means makes a first constant stepwise pivotal movement between said two predetermined positions separated by 180° each time said cutter reaches an end of a side face of said tenon, and said cutter makes a second constant stepwise pivotal movement between said two predetermined positions following each second one of said first constant stepwise pivotal movements.

2. A machine for milling a tenon according to claim 1, wherein:

said sledge means includes a first sledge and a second sledge;

each said sledge includes a displaceable abutment cam; and said first means includes a movable auxiliary sledge provided with adjustable abutments cooperating with said abutment cams.

3. A machine for milling a tenon according to claim 2, wherein:

said sledge means is connected to a first piston means for moving said sledge means;

said auxiliary sledge is connected to a second piston means for moving said auxiliary sledge; and the surface area of said second piston means for moving said auxiliary sledge exceeds the surface area of said first piston means for moving said sledge means.

4. A method of milling a tenon at the end of a beam-shaped workpiece, comprising the steps of:

placing a workpiece on a sledge;

moving a pivoting support carrying a cutter to a first rotary position;

moving said sledge from a first predetermined position to a second predetermined position to cut a first face of said tenon;

moving said pivoting support to a second rotary position to cut a first end of said tenon;

moving said sledge to a third predetermined position by overcoming a constant opposing force imposed upon said sledge to cut a second face of said tenon;

moving said pivoting support to said first rotary position to cut a second end of said tenon; and moving said pivoting support to said second rotary position and simultaneously moving said sledge towards said first predetermined position.

* * * * *